US005898592A

United States Patent [19]

Salgado et al.

[11] Patent Number: 5,898,592

[45] Date of Patent: Apr. 27, 1999

[54] SHEET DELIVERY CONTROL SYSTEM

[75] Inventors: David L. Salgado, Victor; James C. Campbell, Fairport; John W. Daughton, Rochester; Marilyn S. Grzenda, Fairport; John D. Hower, Jr., Fairport; Susan B. Layer, Fairport; Barry P. Mandel, Fairport, all of N.Y.

[73] Assignee: Xerox Corporation, Stamford, Conn.

[21] Appl. No.: 08/876,916

[22] Filed: Jun. 16, 1997

Related U.S. Application Data

[60] Provisional application No. 60/027,034, Sep. 26, 1996.

[51] Int. Cl.[6] ..... B07C 17/00

[52] U.S. Cl. ..... 364/478.02; 364/478.04; 271/298; 271/288; 270/52.03; 270/58.02; 270/58.18; 270/59

[58] Field of Search ..... 364/478.02, 478.04; 271/298, 288; 270/52.03, 58.02, 59, 58.18

[56] References Cited

U.S. PATENT DOCUMENTS

| | | | |
|---|---|---|---|
| 5,161,795 | 11/1992 | Kim et al. | 271/288 |
| 5,308,058 | 5/1994 | Mandel et al. | 271/207 |
| 5,328,169 | 7/1994 | Mandel | 271/298 |
| 5,342,034 | 8/1994 | Mandel et al. | 270/58.01 |
| 5,358,238 | 10/1994 | Mandel et al. | 271/298 |
| 5,435,544 | 7/1995 | Mandel | 271/298 |
| 5,547,178 | 8/1996 | Costello | 270/52.03 |
| 5,551,686 | 9/1996 | Sanchez et al. | 271/298 |
| 5,603,492 | 2/1997 | Mandel et al. | 270/58.09 |
| 5,777,882 | 7/1998 | Salgado | 364/478.02 |

*Primary Examiner*—Joseph E. Valenza
*Assistant Examiner*—Wonki Park
*Attorney, Agent, or Firm*—Gary B. Cohen

[57] ABSTRACT

A method for a sheet handling system where a controller communicates with a mailbox bin subsystem having a plurality of print receiving bins is provided. The plurality of bins are grouped into a first print receiving bin set, a second print receiving bin set and a third print receiving bin set with the first print receiving bin set including one or more print receiving bins, the second print receiving bin set including one or more print receiving bins and the third print receiving bin set including one or more print receiving bins. A first bin access designator is assigned to each print receiving bin of the first print receiving bin set, a second bin access designator is assigned to each print receiving bin in the second print receiving bin set and a third bin access designator is assigned to each print receiving bin in the third print receiving bin set—the first, second and third bin access designators correspond respectively with a first user class type, a second user class type and a third user class type. A request is communicated to and read by the controller. In response to such reading, the one or more produced prints are delivered to one or more print receiving bins in one or more of the first, second and third print receiving bin sets.

17 Claims, 7 Drawing Sheets

| | | | |
|---|---|---|---|
| Bin 1 | Private | Paul | |
| Bin 2 | Public | | |
| Bin 3 | Semi-Private | Dave<br>Kim<br>Barry | |
| Bin 4 | Private | OPEN | |
| Bin 5 | Private/Semi-Private | Conditional | Private for John<br>Semi-Priv. for:<br>⋮ |

| Assignment |
|---|
| Add/Delete Name |
| Impose Condition |

SHEET DELIVERY CONTROL SYSTEM

Priority is claimed to Provisional Application No. 60/027,034, filed Sep. 26, 1996.

CROSS REFERENCE TO D/95381 & D/96441

The Present Application is related in subject matter to and cross-referenced with both U.S. patent application Ser. No. 08/(Attorney's Docket No. 95381) (entitled "Document Job Routing System For A Printing System") and U.S. patent application ser. No. 08/(Attorney's Docket No. 96441) (entitled "Control System For Mailboxing Arrangement"), both of which applications are attributable to the same Applicants as the Present Application, and both of which applications were filed on the same day as the Present Application.

BACKGROUND

This invention relates generally to a sheet handling system particularly suited for use with a printing system and, more specifically, to a method of controlling delivery of prints to or assignment of mailbox bins in a mailbox bin subsystem.

The problem of keeping shared (networked) printer job outputs from becoming mixed up, or accidentally removed by others, especially where commonly stacked, even if the jobs are initially offset, is serious enough that some users have for several years placed manual mailboxes, like Post Office boxes, adjacent the printer, with the boxes labeled with different user names, for manual job sorting. Likewise, for shared facsimile machines.

The following additional partial broad definitions may be helpful to the discussions herein: "Mailbox[ing]": temporarily (or semi-permanently) assigning a unique predetermined electronic address to designated ones of plural bins of a sorter-like output device and enabling a user's output to be directed into a selected bin so assigned. It may or may not include locked bins. Preferably, the user's mailbox output is plural, pre-collated, jobs with all sheets going to a single bin, not requiring sorting. "Sorting": conventionally, this refers to sending one copy sheet of each original page into one bin of a sorter, the next copy sheet into the next bin, etc., repeated for the number of copies, until each of the plural bins required has one copy, then stacking one copy sheet of the next original in each said bin, etc, to compile one collate set in each bin. Thus, job or addressee "mailboxing" is not "sorting" in the common or usual sense of a collating plural identical copy sheets by sequentially placing each sheet in a different bin, and repeating those steps. However, similar "sorter" hardware may be employed in part if it can provide rapid random bin access and other desired features. "Stacking": providing the ability to arrange sets of sheets (which may be stapled or otherwise finished sets of sheets), into a well controlled, generally vertical, common stack, although partial "offsetting" of separate job sets may be desirable.

The term "mailboxing" as used herein refers to handling or sorting physical, i.e., "hard copy" printed sheets. It does not refer to electronic documents or images, which are much easier to manipulate.

To express it in another way, a "mailbox" in the example herein takes multiple print jobs from a printer (from user terminals, fax, networked purge images, scanned document jobs, or the like or combinations thereof) and separates jobs by users and stacks these hardcopy outputted print jobs into individual bins for individual users, by users. [As an additional software option, users may also send print jobs to other users' mailbox bins if desired.] Mailbox bins can, in general, be either user assignable, or automatically assigned by the printer, print server, or mailbox unit. Optionally, jobs can be individually stapled if a stapler unit is provided. Optional security doors can be added to any or all bins if desired. An overflow bin or general, shared, stacking tray may also desirably be provided, not assigned to any one user.

"Mailboxing" may more specifically, as in the example herein, refer to temporarily or permanently assigning a unique and predetermined electronic address to respective ones of plural bins of sorter-like equipment for a copier, printer or facsimile machine output, and enabling a particular user's output of one or more jobs to be directed into one or more selected bins so assigned. It may or may not include means for locking the bins and unlocking access thereto, as indicated above and as in the example herein. It may or may not additionally include a bin assignment scheme wherein each bin has an associated LCD or other type of display with the appropriate user name or label displayed, and/or a common or central display, as in the example herein, and/or wherein jobs are placed in more than one available bin if needed, i.e., if the sheet stacking capacity of one assigned bin is exceeded. As noted, a mailbox for a laser or other electronic page input printer may desirably print and feed plural precollated sets of sheets into a selected bin, rather than functioning as a normal collator or sorter, [although it may do so additionally or alternatively] since an electronic page printer can normally easily electronically reorder and recirculate the "original" pages being copied to "copy" and output them in precollated or serial page job set order, rather than making plural directly sequential copies of each page requiring post-collation and separate bins for each copy set in a sorter or collator.

A very desirable mailbox system feature is a "variable bin assignment" system in which many users can share one mailbox unit with only a limited number of bins by variable (dynamic) bin assignments and their electronic logging or tracking, with the bin assignment(s) for a particular user or group of users, depending on bin availability (the bins empty at any given time) rather then a fixed, permanent assignment of certain bins to certain users or customers. This greatly increases the effective capacity or the number of potential shared users.

Another very desirable and related "mailbox" feature is a "virtual bin" concept, in which the software in a programmed computer or controller controlling the mailbox sheet distributor puts the first job output of user A into an assigned bin X which is determined to be available. Then, if a subsequent job for user A will also fit into bin X, it is also put into bin X. If not, then the subsequent job for user A is automatically put into an assigned "overflow" bin Y, etc. I.e., for each user, the number of assigned bins is automatically increased to meet the users need. Preferably, adjacent bins are used for the job overflow. Art noted re bin overflow features in general includes Xerox Corporation U.S. Pat. No. 3,871,643 issued Mar. 18, 1975 to W. Kukucka and T. Acquaviva; IBM U.S. Pat. No. 4,522,486 to Clark et al. (using the term "virtual bin"); and U.S. Pat. No. 4,134,581 to Johnson, et al.

Another desirable feature is a bin assignment display system wherein the mailbox unit has a central (or bin-associated) LCD or other such bin-identifying operator display, and wherein user's jobs are placed in one, or (if needed) multiple, available bins, with all the appropriate bin(s) identified and displayed for the user name or other identifier, which may also be displayed. [See, e.g., U.S. Pat. Nos. 4,501,419 and 4,437,660, further discussed herein].

The present system is desirably usable for electronic mail hardcopy prints and/or other networked or shared user document prints in general. E.g., in a shared user, networked, printer environment, such as in a modern office environment, the printer can electronically recognize the sender or user terminal sending the printing job from network or document electronic information already available in said job. (Such shared printers may also have alternate scanner or floppy disk document inputs.)

It is additionally noted that combined facsimile and/or digital scanning, copying and printing (and even conventional light lens or digital copying can be provided in one single unit, encompassed by the term "printer" as used herein. Note, e.g., Xerox Corporation U.S. Pat. No. 4,947,345 filed Jul. 25, 1989 and issued Aug. 7, 1990 to Paradise, et al.; U.S. Pat. No. 3,597,071, filed Aug. 30, 1968 and issued Jul. 27, 1971 to Jones; Fuji Xerox Co. Ltd. U.S. Pat. No. 5,038,218, issued Aug. 6, 1991 to Matsumoto; Sharp U.S. Pat. No. 5,012,892, issued Jun. 4, 1991 to Kita, et al.; and IBM Corp. U.S. Pat. No. 4,623,244, issued Nov. 18, 1986 to D. R. Andrews, et al., originally filed Oct. 4, 1976 (see, e.g., Col. 55). Such plural mode or combination printers are commercially available, e.g., the Xerox Corporation "DocuTech", the Fuji Xerox Co. Ltd. "Able" TM machine series (AbleTM 3311, etc.) [Xerox 3010], the Canon "Navigator", and the Okidata "Doc.It" multifunctional ["combo"] product announced Oct. 28, 1992. The latter allegedly provides simultaneous fax, printer, scanner, and copier capabilities, and includes a controller and image processing board that plugs into a user's PC. Faxes are received on the PC's hard disk. Another such multimode unit is the Xerox Corp. "7033" recently announced as a LAN fax server, scanner, copier, LAN print server, and/or digital printer-all in one network-ready unit. This multifunctional and "turnkey" solution integrates various components within a "NetWare TM" environment. A server board can be installed in the "7033" machine to allow a direct connection to the network (via Ethernet or token ring), and the machine can be attached directly to the network (like a network-ready printer), without having to dedicate a PC. The fax software provides shared users access to all of the "7033" terminal's features from their workstations. The fax terminal's software package is named "XPCONSOL" and is a menu-driven software which looks and feels like "PCONSOLE" and likewise, may be used to set up the "7033" as a network print server. The "7033" can handle both addressed and unaddressed incoming faxes. Network workstations can fax from the command line, an application, windows, or the copier-scanner itself. Other new multifunctional units include Xerox' DocuCenters 20 and 35 as well as the Ricoh DS95330, and Cannon GP55 series.

Of further "mailbox" interest, in Seiko Epson Corporation U.S. Pat. No. 5,141,222 issued Aug. 25, 1992 by Shigeru Sawada, et al., (and its equivalent EPO Application No. 0 399 565 "Printer" published Nov. 28, 1990), a modular unit sorter is generally indicated in Col. 1 to be for sharing a printer with a plurality of users, sorting and compiling copies by user. It claims an output sorter having fixed trays and a pivotable sorter guide member for directing copy sheets to a sorter tray. Each tray may also have a gate mechanism for retaining sheets in the tray. It is suggested in Col. 6 that a mailbox can be assigned or dedicated to each user, and used as a "mailbox" by entering an ID code and printing data. This reference is also of interest re detecting the fullness of a sorter bin and for delivering copy sheets to the next available sorter bin. I.e., also disclosed in said U.S. Pat. No. 5,141,222 reference Col. 8 are means for detecting the fullness [reaching of sheet stacking capacity] of a tray and incrementing this sorter tray copy sheet guide to another (empty) sorter tray. As noted, another example of that is disclosed in that above-cited Canon U.S. Pat. No. 4,501,419, issued Feb. 26, 1985 to Y. Takahashi, et al. (also cited herein re its bin entry gating and its bin display features).

Printer products noted with integral open sorter bins [the bin selection system is not known] include the Canon NP-9030 sold for several years with a sorter option; the Kyocera F-2010 and F-3010 laser printers with their 5 bin sorter option (since 1988?); and Oce van der Grinten Corporation's recently commercially displayed "6750" and "6800" printers configurable with either 20 or 40 bin optional programmable sorter/mailboxes. Toshiba and its OEM Genicon recently announced a 10 bin "mailbox sorter" for their network printers, supported by a Windows driver. The Toshiba user selects a bin number from the driver menu (not the network). Thus, users all have to agree among themselves who gets what bins. The Genicon system allows the network administrator to assign bins.

Variable/dynamic assignment of mailbox bins is discussed in U.S. patent application Ser. No. 08/585,079, entitled "Sheet Stacking Bin Fullness Control System" and filed originally as a provisional application (Ser. No. 004,825) on Oct. 5, 1995 by Mandel et al. As indicated by the '079 Application:

> As variously taught by above-cited patents, the disclosed mailboxing system can provide for stacking the sheets sequentially outputted from the printer 14 in separate job sets into one or more temporarily and/or variably reassignable mailboxes 11 of the mailboxing or job sorting accessory unit. This assignment can be by a mailbox controller 100 controlling a sheet distribution system such as 16, automatically and/or with keypad 102 and/or display 104 entry by a user or system administrator, and/or with initial setups in NVM by the installer, and/or or remote terminal electronic setups or changes such as from remote workstations 15. The setups and/or defaults can be for the entire mailbox or for individual bins. As will be further discussed, the system setup my may include assigning more than one user to one or more bins, e.g. a workgroup or team and/or a secretary may share bins. Some or all of the assigned mailboxing units or bins thereof may have "privacy doors" which are normally locked to restrict access to at least some of the mailbox bins, with electrical unlocking of selected bins privacy doors in response to entry of a access code for that user on the keypad 102 or elsewhere, and/or other features, as also described in the above cited mailbox patents.
>
> As taught in those cited patents, what is normally desired for the output for each utilized mailbox bin is plural, pre-compiled, preferably offset (and/or pre-stapled) job sets stacked in selected bins respectively assigned to respective users of the printer 14. What is also desirable is an automatic overflow assignment system of additional temporarily designated bin(s), as needed, to provide effectively unlimited or "virtual bin" plural job stacking. As will be further described, this bin reassignment and/or job overflow system is preferably integral with and controlled by the disclosed bin full and/or bin-almost-full sensing systems herein. As is also described in said cited mailbox patents, a variable display such as 104 may be provided to indicate the assigned bin and any overflow bins into which that particular users print jobs have been placed last and not yet removed. This instructional display can also be on the respective user terminal 15 display (FIG. 6). That is, the mailbox system or system server can automatically generate network messages sent back to the user's (job senders) terminal 15, and/or to the systems administrator terminal 15, if desired, so that the terminal 15 screen displays a status message like "your print job is completed—remove it from bins #3 and 4"; or "the printer is out of paper"; or "all bins are full—clear bins to continue printing", and the like.

As further described in said U.S. Pat. No. 5,328,169 and related patents, one aspect of such a "dynamic" (variable) user bin assignment system is that each "mailbox" (separate bin to be utilized therefor) can be frequently checked (updated) for reassignment of that bin to a new user. That is, reassignment to other users of bins which have since become available by the removal of all the printer output sheets therefrom by the previous user of those bins. The mailbox controller 100 can periodically interrogate the bin-empty sensors 40 to see which bins 11 are then empty. This interrogation is preferably done each time the printer and/or print server is sent (and/or is preparing to print) a print job. Unlike a sorter or collator, it is not necessary to free up (empty) a whole series of bins. Any one free bin can be fed job sheets, even if that one empty bin is between other, unemptied, bins. The bins assigned are then stored in memory, and can be identified whenever jobs are to be retrieved. However, as discussed elsewhere herein, there are situations is which having only a bin-empty sensor can be inadequate.

Additionally, U.S. Pat. No. 5,358,238 to Mandel et al. discloses a dynamic "mailboxing" unit and system for separating by users the sheet ouptuts of various users of a shared users printer (including facsimile receivers, copiers or combination units). The unit and system provide for stacking the sheets sequentially outputted from the printer in separate job sets into one or more temporarily and variably assigned "mailboxes" of a "mailboxing" job sorting accessory unit having a number of variably assignable "mailbox" bins.

There are assignment situations which are not believed to be addressed by the prior art:

In one example, a user may wish to have an output of their job delivered to a mailbox bin even when such output would not normally be delivered to a mailbox bin. In particular, the developer of a copy job, in which a hardcopy is scanned for delivery of prints to an output tray, may desire an approach in which the job output is delivered to a mailbox bin in view of a current state of a host copier upon which the copy job is being developed. For multifunctional copiers with secured boxes intended for use in receiving prints from print jobs, rather than copy jobs, however, this is not believed to be an approach that is normally made available. It would be desirable to provide copy job developers with the opportunity, under certain circumstances, to deliver his/her copy job to a mailbox which would normally be configured for a print job.

In another related example, the user of a mailboxing system may desire to deliver one type of job to a first set of one or more mailbox bins and another type of job to a second set of one or more mailbox bins. In particular, a user may develop one job that is preferably delivered to a nonsecured bin and another job that is preferably delivered to a secured bin. It would be desirable to provide the user with the ability to dynamically control the one or more mailbox bins to which the job is to be delivered.

In yet another related example, the number of mailbox bins available in a given system may be exceeded by the number of users who wish to access such bins. That is, during a given time interval, X users may seek to use Y bins where Y is significantly greater than X. Among the X users, however, there may be some users that should be provided with immediate preferential treatment. Moreover, certain users, due to a certain affiliation, e.g. being affiliated with the same workgroup, may be in a position to share a given secured mailbox bin rather than demand exclusive use of a single secured mailbox bin. In other instances, where a user is denied access to either a private or group shared bin, s/he may be in a position to have a corresponding job routed, at least on a one time basis, to a bin made available to the public as a whole. While it is known to configure a plurality of bins into a private group and a public group, such configuration does not accommodate for needs of users who are willing to share a bin with others, but still desire a level of privacy that is not afforded by a public bin. It would be desirable to provide a mailbox bin subsystem in which levels of use other than simply private and public are afforded.

In application of such bin configuration, it may be desirable to change bin access rights automatically. For example, it might be desirable to change access rights when one or more users fails to use a bin over a selected period of time. It is known, as a result of the disclosure of U.S. Pat. No. 5,435,544 to Mandel, that a group of mailbox bins can be monitored to determine when a job has been left in one of the bins for an unacceptable period of time. In one instance, an operator (e.g. system administrator) can be instructed to remove jobs from bins that have been deposited in the bins more than 24 hours earlier.

The presently disclosed system may be readily operated and controlled in a conventional manner with conventional control systems. It is well known in general and preferable to program and execute such control functions and logic with conventional software instructions for conventional microprocessors. This is taught by various patents such as U.S. Pat. No. 4,475,156 and art cited therein, and various commercial facsimile machines, copiers and sorters. Such software may of course vary considerably depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems.

Other mailboxing patents which might be useful to an understanding of the present disclosure include U.S. Pat. No. 5,551,686 to Sanchez et al. (Issued: Sep. 3, 1996), U.S. Pat. No. 5,547,178 to Costello (Issued: Aug. 20, 1996) and U.S. Pat. No. 5,342,034 to Mandel et al. (Issued: Aug. 30, 1994). All references cited in this specification, and their references, are incorporated by reference herein where appropriate for appropriate teachings of additional or alternative details, features, and/or technical background.

SUMMARY OF THE INVENTION

In accordance with one aspect of the present invention there is provided a method for use with a system in which a controller communicates with a mailbox bin subsystem having a plurality of print receiving bins. In practice, a user requests that one or more prints, produced in accordance with a set of control instructions for a document job be delivered to the mailbox bin subsystem. Preferably, the controller causes the one or more produced prints to be delivered to one or more of the print receiving bins in response to receiving a request communicated thereto by the user. The method, which permits control of delivery of the one or more produced prints to the mailbox bin subsystem comprises: (a) grouping the plurality of bins into a first print receiving bin set, a second print receiving bin set and a third print receiving bin set with the first print receiving bin set including one or more print receiving bins, the second print receiving bin set including one or more print receiving bins and the third print receiving bin set including one or more print receiving bins; (b) assigning a first bin access designator to each print receiving bin of the first print receiving bin set, a second bin access designator to each print receiving bin in the second print receiving bin set and a third bin access designator to each print receiving bin in the third print receiving bin set, with the first, second and third bin access designators corresponding respectively with a first user class type, a second user class type and a third user class type; (c) communicating the request to the controller; (d) reading the request with the controller; and in response to said (d), delivering the one or more produced prints to one or more print receiving bins in one of the first, second and third print receiving bin sets.

In accordance with yet another aspect of the present invention there is provided a method for use with a system in which a controller communicates with a mailbox bin subsystem having a plurality of print receiving bins. In practice, a user of the print delivery subsystem requests that one or more prints, produced in accordance with a set of control instructions for a document job be delivered to the mailbox bin subsystem. Preferably, the controller causes the one or more produced prints to be delivered to one or more of the print receiving bins in response to receiving a request communicated thereto by the user. The method, which permits control of delivery of the one or more produced prints to the mailbox bin subsystem comprises: (a) grouping the plurality of bins into a first print receiving bin set, a second print receiving bin set and a third print receiving bin set with the first print receiving bin set including one or more print receiving bins, the second print receiving bin set including one or more print receiving bins and the third print receiving bin set including one or more print receiving bins; (b) assigning a first bin access designator to each print receiving bin of the first print receiving bin set, a second bin access designator to each print receiving bin in the second print receiving bin set and a third bin access designator to each print receiving bin in the third print receiving bin set, with the first, second and third bin access designators corresponding respectively with a first user class type, a second user class type and a third user class type; (c) configuring the request to indicate a preference as to which one of the first, second and third print receiving bin sets is to receive the one or more produced prints, wherein said preference is provided in the form of a list designating one or more print receiving bins to which the one or more produced prints are to be delivered; (d) communicating the request to the controller; (e) reading the request with the controller; and (f) in response to said (e), delivering the one or more produced prints to the one or more print receiving bins designated in the request when the one or more print receiving bins designated by the request are available to receive the one or more produced prints.

DETAILED DESCRIPTION OF ONE OR MORE EMBODIMENTS

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
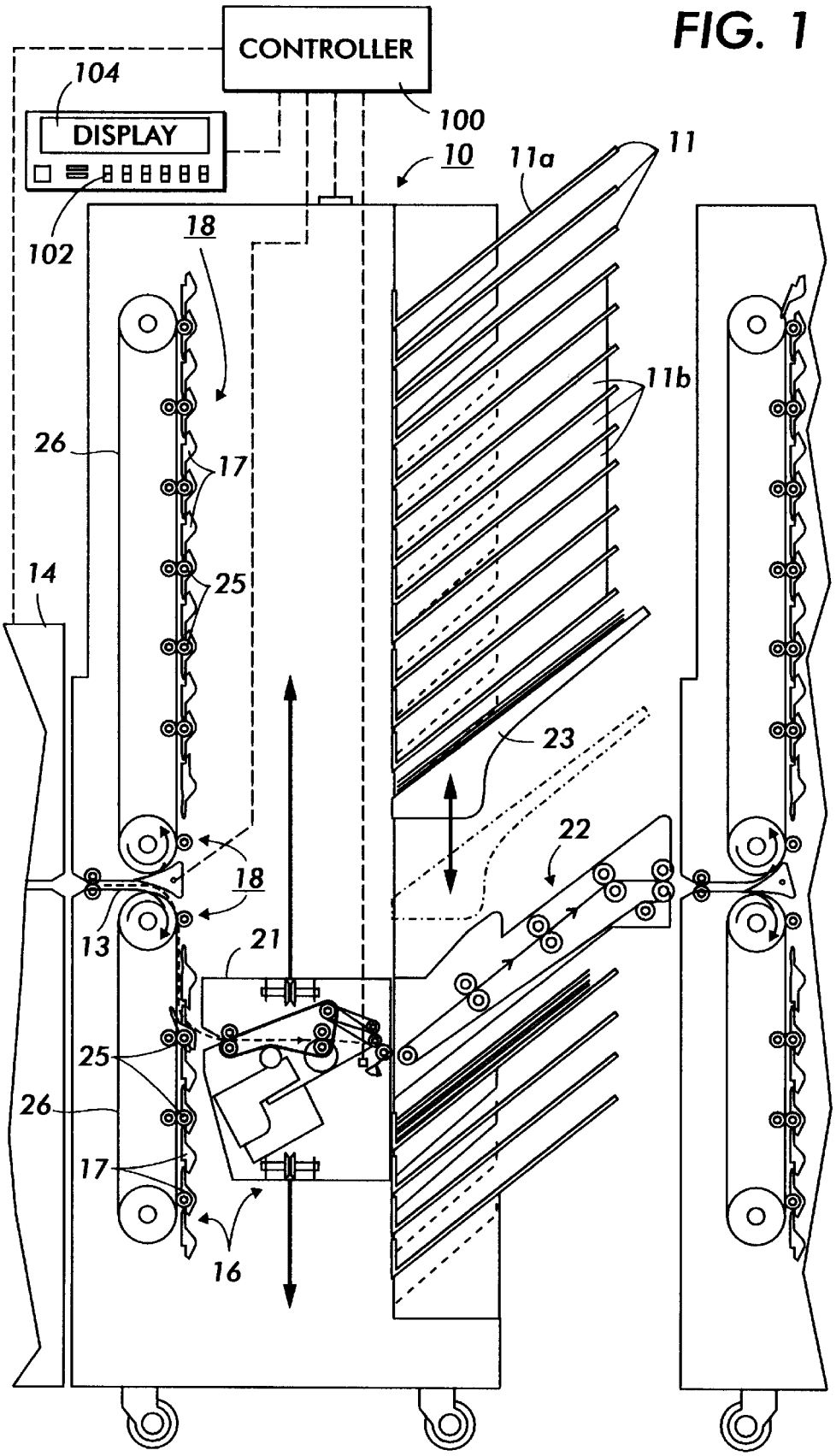
FIG. 1 is an elevational view of one example of a multibin array "mailboxing system unit connecting with the sheet output of a printer (partially shown schematically) with an example of a repositionable sheet transport and bin selection or distribution system.

Referring to FIG. 1, an exemplary embodiment of a mailbox unit is designated with the numeral 10. The mailbox bins, 11, 11*a*, 11*b*, etc., illustrated or described herein are also merely exemplary, and may vary considerably. The general reference number 11 is used throughout for any individual mailbox (bin). Bin 11*a* here is an open overflow bin, conventionally located here as the top bin. In one example, the Bin 11*a* could be employed as a high capacity bin. This top bin or tray 11*a* of the unit 10 may conventionally provide an open or "public" bin. A top bin is commonly used for undesignated or unknown user's jobs, job overflows, jam purges, etc., since it is not limited in stack height by any overlying tray. Bins 11*b* here schematically represents some examples of restricted access mailbox bins 11 which are lockable and unlockable, e.g. have latched privacy doors, as described further in the above cited patents thereon.

Figure 2:
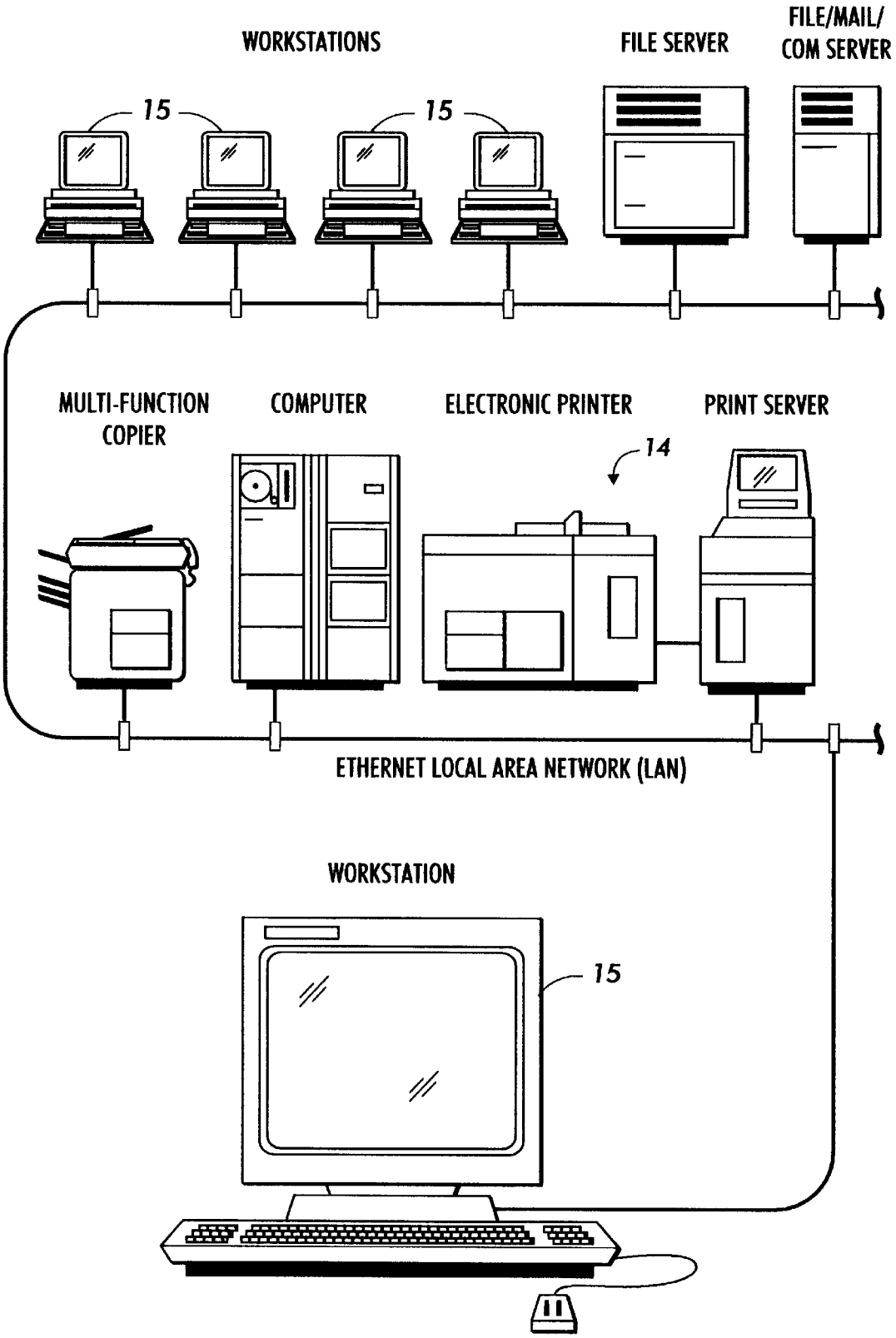
FIG. 2 PRIOR ART
FIG. 2, labeled "prior art", is a schematic overall view of one example of an electronically networked system of plural users (plural workstations) sharing an electronic printer and a multifunctional digital copier with a digital front end.

Various printers (of which printer 14 in FIGS. 1 and 2 is merely one schematic example) may be connected to these and other mailboxing systems, with little or no printer modifications, as part of various systems. In FIG. 2, merely by way of an example of systems applications, the exemplary shared user electronic printer 14 is shown connected into a conventional prior art inneroffice or interoffice system electronic network with various remote user terminals (workstations) 15, one of which is shown here in an enlarged view. Some other possible typical network system components are also illustrated and labeled. For example, a multifunctional printing system, including, printing copying and faxing functionality, is shown. A discussion of network printing is provided in U.S. Pat. No. 5,358,238 to Mandel et al.

Preferably the mailbox unit has a sheet input or entrance such as 13 which adapts or adjusts to common or various printer output levels, or an interface unit or interconnect transport may be provided in a known manner to sequentially feed the printer output sheets from the printer 14 into the mailbox unit 10 sheet entrance 13. Alternatively, the mailbox unit can be integral with the printer unit, built into or attached above or to one end thereof, such as by conventionally integral cantilever mounting to or above the output end of the printer 14, like certain known sorters. The conventionally sequentially received hard copy of plural page documents from the pre-collation output electronic printer 14 or the like is thus fed into the mailbox unit 10, along with any added or interposed insert sheets, such as covers, tab sheets or color photographs, to make up desired print jobs. The path of these sheets in the mailbox unit is via a sheet distribution system 16 automatically controlled by a controller 100, or otherwise, for the particular bin 11 assignment or destination of the particular job sheets. As noted previously, and extensively discussed in above-cited patents, the mailbox unit 10 preferably directs all designated sheets of a users job to an available bin or bins 11 which are temporarily assigned to that particular printer user, based on bins availability, which may be an empty bin or a bin which is not yet full.

Preferably, each bin 11 has an individual "bin empty" sensor (not shown herein), such as that described in Xerox Corp. U.S. Pat. No. 5,328,169 issued Jul. 12, 1994 to Mandel, each of which bin empty sensor communicates with the controller 100. This enables the sheet path control bin selection system of the mailbox unit 10 to know immediately when any bin has been fully cleared by anyone (a printer user, print job or facsimile addressee, recipient, system administrator, etc.). Thus, any empty bin can be refilled with further print jobs for the same designee(s), or immediately reassigned to a new user, job addressee or recipient. This is the case even where the same mailbox bin or bins may be allowed to shared by more than one user or addressee, since, notwithstanding directions or displays to the contrary, any user or addressee with access to that bin could remove all the print jobs in that bin, not just his or her own print jobs. However, if only his or her own print jobs are removed from that shared bin, and there are any print jobs for others left remaining in that bin, or reinserted back into that bin, the bin empty sensor cannot tell how much material was removed, or how much stacking space is thus now available, as even a single remaining sheet in the bin will block such a bin empty sensor.

A bin fullness sensor, such as those described herein, or others, could be modified to additionally sense empty, and thus fully available, bins, and eliminate any need for separate bin empty sensors. E.g., by providing for the end of the stack height sensor arm extending into the bin to partially drop though a hole or slot in the bin tray bottom to an arm position triggering another optical or other sensor for that bin empty arm position, as is well known in the set separator sensor art for recirculating document handler trays. However, since here a single stack height sensor is desired to be used and shared for all the bins in the array of bins, that would require this single sensor to be frequently moved up and down the array of bins to check for emptied bins. That would reduce productivity while that is being done.

Thus here, bin empty sensing is combinable with, but distinct from, the presently disclosed system for checking for full or almost full bins, since the single stack height sensor disclosed here for that function in mailbox units is mounted on, and moves with, the mailbox carriage unit 21 which is part of the sheet distribution system 16 directing sheets into the particular bin 11 which is then being filled here. Thus, the stack height sensor system here is already automatically located adjacent to the particular bin 11 who's stack height needs to be sensed or measured during filling since it is the bin being filled at that time. However, unlike bin filling, as to bin emptying, any mailbox bin 11 may be manually emptied at any time, unless it is a locked bin 11*b*. Even if the controller 100 receives an unlocking signal or password, it will only know which bins 11*b* have been unlocked then, and will not know whether or not those unlocked bins have actually been either partially or fully emptied, unless there is a bin empty detection or sensing signal from that bin.

Referring further to the illustrated exemplary mailbox unit 10 in FIG. 1, this is a universal stand-alone unit that is attached to, or simply moved next to, the output of almost any conventional printer. This particular illustrated mailbox unit 10 is basically that shown and described in the above cited and incorporated prior Xerox Corporation mailbox unit U.S. Pat. Nos. 5,382,012 issued Jan. 17, 1995, and 5,370,384 issued Dec. 6, 1994, and thus need not be re-described in detail here. This particular mailbox unit 10 has plural fixed bins 11, into which either single sheets, or collated and stapled or unstapled job sets of multiple sheets, are selectively fed by a sheet distribution system 16, here including a vertically repositionable (movable) bin selector carriage 21. As further described and disclosed in above cited prior patents, the movable carriage 21 comprises an integral sheet set collator and finisher unit which may be called a finishing carriage. The selected vertical position of the finishing carriage 21 here also serves to cam actuate the selected corresponding position sheet deflector gate 17 in the sheet vertical transport path 18 on the upstream side of the finishing carriage 21, so as to select the sheet path from the transport path 18 through the carriage 21 into the adjacent selected bin 11. The belts 26 of the vertical transport 18 are laterally spaced apart so that the fingers of the selected gate 17 may pivotally extend between the belts 26 when that gate 17 is actuated. The particular vertical transport 18 here has sets of both up and down flights of moving belts 26, each with mating belt rollers 25, to allow for the mailbox unit 10 sheet entrance 13 to be centralized by entering in between these up and down belt flights.

This internal sheet feeding and/or sheet distribution system in the mailbox unit can utilize various other alternative different known random access bin selector type sorter sheet transports, many of which are known in the art. Various well known feeding and gating arrangements whereby inputted sheets are fed to and gated into selected bins include, for example, a moving gate sheet deflector system without a compiler or finisher, such as is disclosed in Norfin Co. U.S. Pat. No. 3,414,254 to Snelling, et al.

The collator, stapler and stapling system on the finishing carriage 21 may be, for example, that further described in Xerox Corporation U.S. Pat. No. 5,398,918 issued Mar. 21, 1995, to C. Rizzolo, et al. It provides stapling in one or more locations selected by linear movement of a stapling head along a stapling line, which line position may be preset to a small fixed distance parallel to one edge of the compiled set. Thus, as finished sets are stacked into a bin 11 from the finishing carriage 21, any staples in the print job set are known to be somewhere along a known position line.

As is also shown here with this exemplary mailbox unit 10 in FIG. 1, additional mailbox units such as 10 can be extended or serially connected to provide additional sets of available bins 11, where desired, as is well known in sorting. That is, plural mailbox units 10 may be ganged in series like plural sorter units using sheet pass-through or bypass feeders such as 22 shown here. This is further described in said Xerox Corporation U.S. Pat. Nos. 5,382,012 and 5,370,384.

The relatively low capacity (e.g., less than 100 normal sheets) mailbox bins 11 normally used for separating by users their plural printing jobs, which may include copy or fax jobs, may also be supplemented by optional or overflow sheet delivery into a high sheet capacity stacking tray system, such as the FIG. 1 elevator stacking tray 23, which is desirably part of the same vertical array of bins, and desirably selected and fed sheets or sets of sheets by the same sheet distribution system 16. That can be an optional module mounted onto the same frame in place of one or more of the mailbox bins 11, as disclosed in above-cited patents, especially U.S. Pat. Nos. 5,382,012 or 5,370,384. The structure and operation of such an elevator stacking tray 23 is well known per se, and described in some of the above cited patents. An elevator motor system connecting with the elevator tray 23 maintains the top of the stack of accumulating sheets thereon at a suitable height below the sheet input to that stack, which here is the exit or eject rollers nip of the finishing carriage 21. This typically requires a separate sensor and sensing arm to sense the stack height in the elevator tray 23 to control the actuation of the tray elevator motor.

It will be appreciated that the stacking height or sheet capacity of the bins in any given mailbox unit may vary. A sorter or mailbox may have repositionable trays for changing their spacing. Furthermore, certain bins such as lockable mailbox bins or bins with privacy doors may have a somewhat smaller usable available spacing between bins and/or stacking height and thus bin capacity, due to thicker tray materials, the bin door locking mechanisms, or the set removal system from the tray, etc. Privacy door restricted access bins are described in detail in the above cited patents, and schematically shown at 11*b* in FIG. 1. Bins which are to be shared by more than one user might be higher capacity bins than those bins which will not be shared. As discussed, the top bin typically is an overflow bin with much higher maximum stacking level or capacity, since there is no overlying or superposed tray. Additional overflow or large jobs stacking can be provided by a special stacking tray, as exemplified by the high capacity elevator stacking tray 23 shown in FIG. 1 and further described herein.

As variously taught by above-cited patents, the disclosed mailboxing system can provide for stacking the sheets sequentially outputted from the printer 14 in separate job sets into one or more temporarily and/or variably reassignable mailboxes 11 of the mailboxing or job sorting accessory unit. This assignment can be by a mailbox controller 100 controlling a sheet distribution system such as 16, automatically and/or with keypad 102 and/or display 104 entry by a user or system administrator, and/or with initial setups in NVM by the installer, and/or or remote terminal electronic setups or changes such as from remote workstations 15. The setups and/or defaults can be for the entire mailbox or for individual bins. As will be further discussed, the system setup my may include assigning more than one user to one or more bins, e.g. a workgroup or team and/or a secretary may share bins. Some or all of the assigned mailboxing units or bins thereof may have "privacy doors" which are normally locked to restrict access to at least some of the mailbox bins, with electrical unlocking of selected bins privacy doors in response to entry of a access code for that user on the keypad 102 or elsewhere, and/or other features, as also described in the above cited mailbox patents.

As taught in those cited patents, what is normally desired for the output for each utilized mailbox bin is plural, pre-compiled, preferably offset (and/or pre-stapled) job sets stacked in selected bins respectively assigned to respective users of the printer 14. What is also desirable is an automatic overflow assignment system of additional temporarily designated bin(s), as needed, to provide effectively unlimited or "virtual bin" plural job stacking. As will be further described, this bin reassignment and/or job overflow system is preferably integral with and controlled by the disclosed bin full and/or bin-almost-full sensing systems herein. As is also described in said cited mailbox patents, a variable display may be provided to indicate the assigned bin and any overflow bins into which that particular users print jobs have been placed last and not yet removed. This instructional display can also be on the respective user terminal 15 display (FIG. 2). That is, the mailbox system or system server can automatically generate network messages sent back to the user's (job senders) terminal 15, and/or to the systems administrator terminal 15, if desired, so that the terminal 15 screen displays a status message like "your print job is completed—remove it from bins #3 and 4"; or "the printer is out of paper"; or "all bins are full—clear bins to continue printing", and the like.

As further described in said U.S. Pat. No. 5,328,169 and related patents, one aspect of such a "dynamic" (variable) user bin assignment system is that each "mailbox" (separate bin to be utilized therefor) can be frequently checked (updated) for reassignment of that bin to a new user. That is, reassignment to other users of bins which have since become available by the removal of all the printer output sheets therefrom by the previous user of those bins. The mailbox controller 100 can periodically interrogate the bin-empty sensors to see which bins 11 are then empty. This interrogation is preferably done each time the printer and/or print server is sent (and/or is preparing to print) a print job. Unlike a sorter or collator, it is not necessary to free up (empty) a whole series of bins. Any one free bin can be fed job sheets, even if that one empty bin is between other, unemptied, bins. The bins assigned are then stored in memory, and can be identified whenever jobs are to be retrieved. However, as discussed elsewhere herein, there are situations is which having only a bin-empty sensor can be inadequate.

Figure 3:
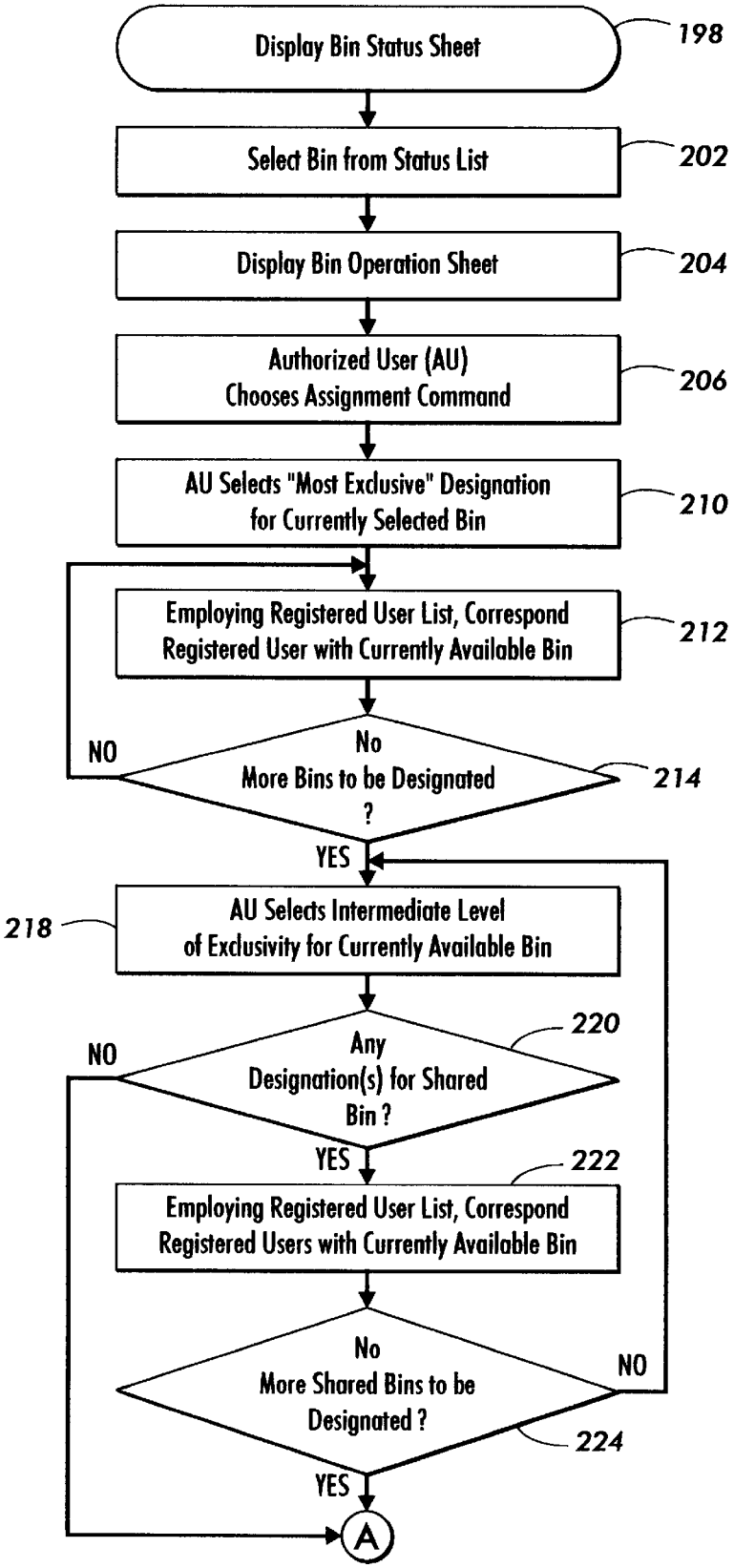
FIG. 3 and 4 comprise a flow diagram illustrating a technique for assigning bin access designators to selected groups of mailbox bins.
Figures 4, 5:
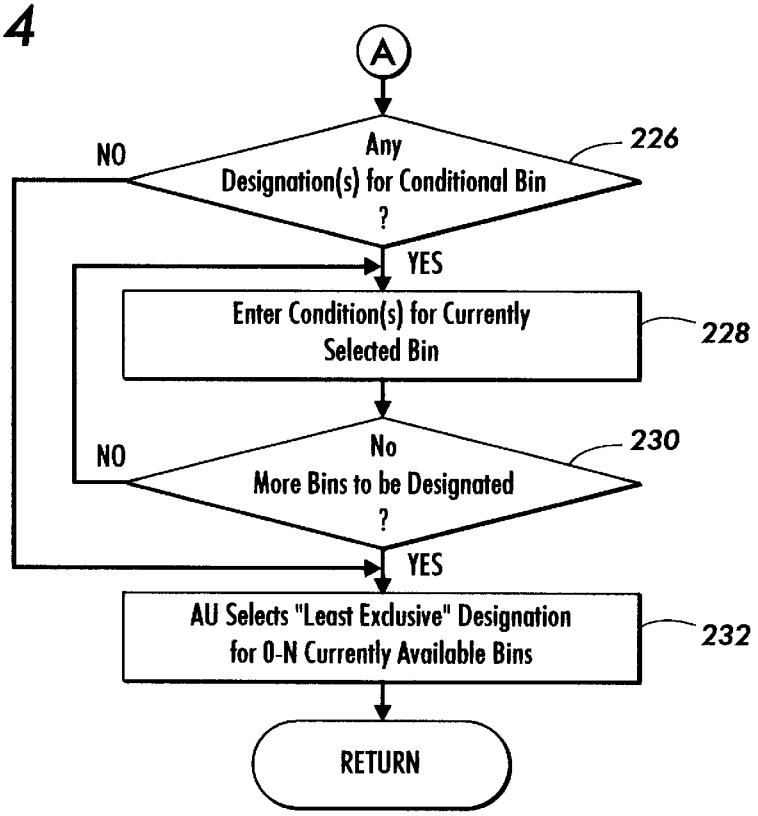
FIG. 5 is a schematic elevational view of a dialog used to facilitate the bin assignment technique portrayed in FIGS. 3 and 4.

Referring to FIGS. 3–6, a system for assigning mailbox bins by an authorized user or system administrator, and controlling the delivery of sheets to such bins, is shown. Referring specifically to FIGS. 3 and 5, an approach for designating bin groups, according to use type, is discussed in detail. For initial setup, a bin assignment dialog 196, which indicates those bins available for configuration/reconfiguration, is displayed at step 198. In the illustrated approach of FIG. 3, one of the bins is selected from a list 200 (FIG. 5)—the list being representative of a window into a database (step 202 of FIG. 3)—and a sheet 203, designating what operations can be performed on the bins in the database window, is displayed by way of step 204. As shown in FIG. 5, the list of operations includes a bin assignment command, which command is selected, at step 206, by an authorized user. In the illustrated technique of FIGS. 3 and 4, the dialog 196 is opened once and maintained in the open state throughout the assignment process; however, it is contemplated that the dialog could be opened and closed throughout the process depending on design choice.

Referring specifically to the list 200 of FIG. 5, some of the bins are corresponded with a bin access designator. For example, bin 1 is corresponded with a "Private" designator, bin 3 with a "Semi-priv[ate]" designator, bin 5 with a conditional designator (referred to, in one example, as "Priv./Semi-Priv.") and bin 2 with a "Public" designator—the significance of these designators, as they appear in the priority of (1) private, (2) semi-private, (3) conditional and (4) public will appear from the following discussion of FIGS. 3 and 4.

It should be understood that a bin access designator dictates the exclusivity which is to be accorded one or more mailbox or print receiving bins. As discussed in the above-mentioned mailboxing patents, a bin may have a particularly high level of exclusivity in that it is intended to be employed for single, private use or a particularly low level of exclusivity in that it is intended to be accessed by any member of the public. Semi-private boxes are typically used by a group that is related through a common purpose—for example each member of the group may be part of a common "workgroup". A Semi-private box may also be one in which the exclusivity of the box depends on the occurrence of an event or condition. While the present description addresses four levels of exclusivity, the precepts underlying the preferred embodiment would not be undermined by use of more or less than four levels of exclusivity.

Additionally, it should be appreciated that a private or semi-private box can be locked or open. Two locking systems, namely a mechanical locking system and an electronic locking system are contemplated by the preferred embodiment—a mechanical locking system is disclosed by the mailboxing patents above. The electronic locking system is directed toward an approach in which a job is held in memory until a password is provided by a selected user at a suitable interface. A hold and release system of this type is disclosed in U.S. Pat. No. 4,843,571, the disclosure of which is incorporated herein by reference.

At step 210, the AU selects one of the lines in the list 200 (FIG. 5) and provides the corresponding bin with a most exclusive or "Private" designation. In configuring the selected bin, the AU preferably accesses a list of registered users (not shown) including candidates for assignment to bins of the mailbox bin subsystem. A name from the list is then corresponded with the selected bin.

Storage of a user list and appropriate employment of such list is well known in the art. For example in one version of Microsoft Mail, a user addresses mail items through use of a list referred to as an "address book". Additionally, as mentioned above, the list 200 is preferably part of a data base which can be subjected readily to search operations. Thus, if "Paul" is assigned to bin 1, a suitable search request, as discussed in further detail below, permits delivery to Paul's bin by use of the database. As each bin selected with step 210 is configured, via step 212, it is determined, via step 214, whether any more bins are to be designated with the Private bin access designator.

If no further bin access designators are to be assigned in the most exclusive or Private category, then the process permits the AU, via step 218, to select a bin for designation at an intermediate or "Semi-private" level of exclusivity. Provided that the Semi-private bin is intended for use as a shared bin (see step 220), the Semi-private or "Shared" bin is configured with a group of user names by reference to a suitable registered user list. In an approach contemplated by the preferred embodiment, a name can be added or deleted from the group of user names by suitable use of the sheet 203 (FIG. 5) in conjunction with the list 200. In one instance, the user name group of bin 4 could be modified by selecting "Dave" and deleting the same with the "Delete" command of sheet 203. Referring to step 224, assuming that no more workgroup type shared bins are to be configured, the process may move through decision 226 to step 228 where one or more conditions can be added for a currently selected bin.

One of various conditions may be set by the AU with respect to the use of one or more bins. For example, a bin may be designated as a workgroup shared bin until a predesignated user indicates with suitable input (e.g. one or more signals) to the controller 100 (FIG. 1), that the exclusivity level of the bin is to be raised from a Semi-private level to the Private level. Referring to the example of FIG. 5, bin 5 is configured so that the bin is treated as a private bin for each of John's jobs, but as semi-private when an authorized workgroup participant other than John sends his/her job output to the bin 5. Other conditions are contemplated for use with conditioned boxes.

Once shared and/or conditioned bins have been designated, by use of decision step 230, the AU is free to designate any other available bin (step 232) as a "Least Exclusive" use type bin. In one example, a Least Exclusive designation for a mailbox bin would designate that the bin is made available to the public at large on a first-come first-serve basis.

Figure 6:
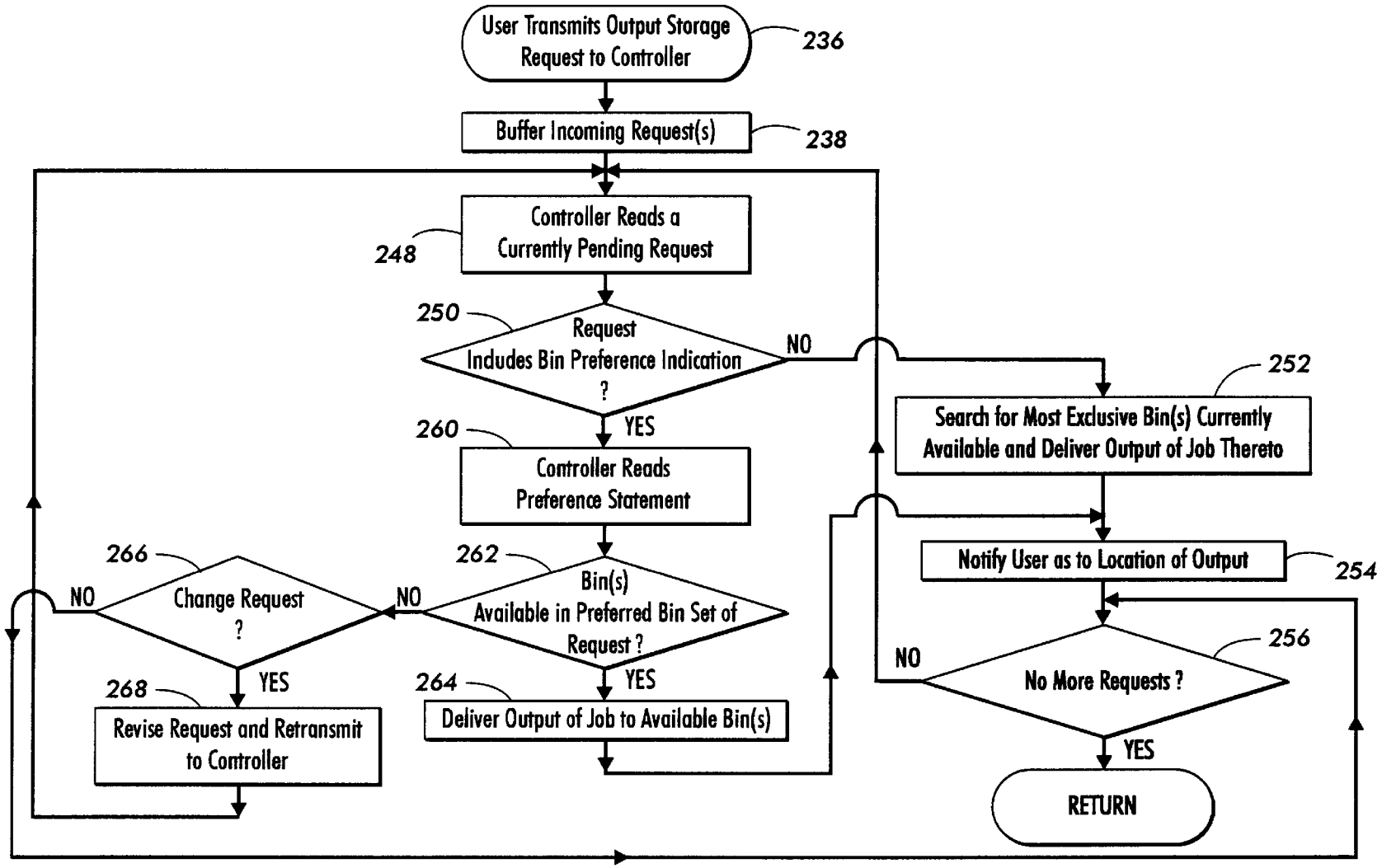
FIG. 6 is a flow diagram illustrating an interactive technique in which an output storage request is used to facilitate the delivery of job output to one or more preassigned mailbox bins.

Referring to FIG. 6, a manner of using the class designating approach of FIGS. 3 and 4 is discussed. Pursuant to developing control instructions for a document job with a suitable job ticket (of the type shown in U.S. Pat. No. 5,206,735 to Gauronski et al., the disclosure of which is incorporated herein by reference), a user desirably designates, by way of an output storage request (step 236) (also see FIG. 7) that the output of the job, i.e. prints, is to be delivered to one or more mailbox bins corresponding with one or more bin access designators. As will appear, the developer of a document job can designate, with a varying degree of specificity, which type(s) of bin(s) is to receive the document job output. In the preferred embodiment, the user stores the job ticket, including the output storage request, for future use in processing the job. It will be appreciated that the output storage request can be developed and buffered (step 238) at any time prior to delivery of the document job output to the mailbox bin subsystem of FIG. 1.

Figure 7:
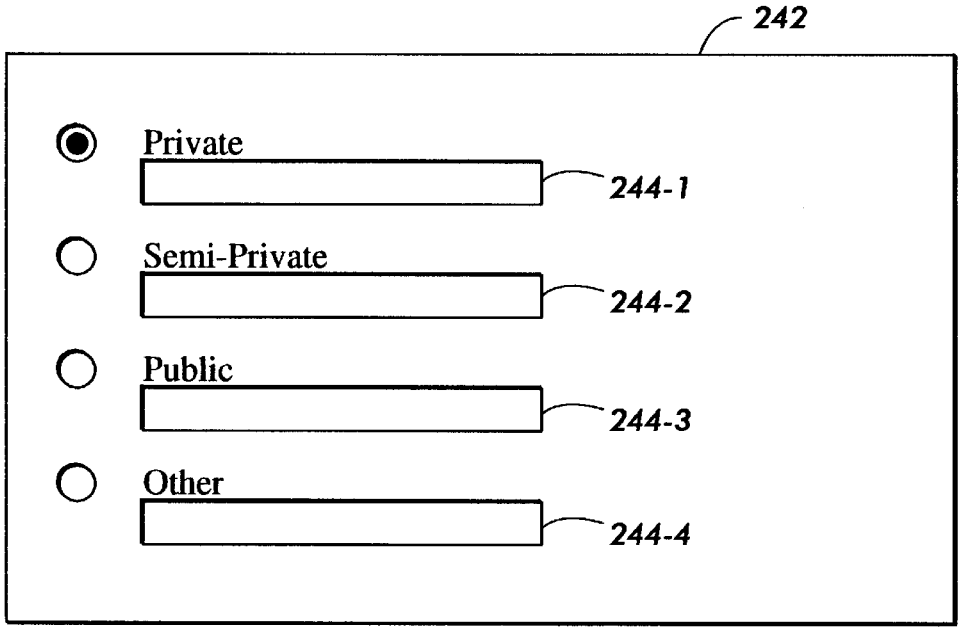
FIGS. 7–9 each include a schematic, elevational view of a dialog used to implement, in one example, the output storage request of FIG. 6.

Referring to FIG. 7, an output storage request ticket is designated by the numeral 242. Preferably, the ticket 242 permits a user to choose up to three levels of use type. The present approach contemplates a system in which the user either designates (1) none of the levels, (2) just one of the levels, (3) two of the levels, or (4) three of the levels. In the dialog of FIG. 7, the choice of a conditional bin is incorporated in the Semi-private choice, but in another embodiment, the choice of a conditional bin could be broken out into a separate choice. As explained in further detail below, each level includes an input/display area 244-X by which the user can specify bin preferences or indicate specific bins for receiving output copy(ies). In order to provide the user with an optimum level of flexibility, a choice referred to as "Other", the significance of which is discussed in further detail below, is provided. Additionally, the input/display area can be used to prompt the system to provide a user with information regarding those bins that are currently assigned to him/her. In particular, a user may query for "Paul's bins" and a search of a corresponding database, such as the database corresponding with the list 200 of FIG. 5) permits for a listing of Paul's bins, one of which, as shown in FIG. 5, includes Bin 1.

Pursuant to processing a document job, the controller 100 (FIG. 1) reads one of the requests in the buffer (step 248) and determines, at step 250, whether the request expresses a preference as to where an output of the job should be delivered. In the event that no preference is stated, then a search is performed with the controller (step 252) to determine if a Private bin is open. In the example, Bin 5 is open so the job output (i.e. prints) are transmitted thereto and, after delivery of the job output to Bin 5, the corresponding user is notified with the controller (step 254) that the job output resides therein. If no Private bins are available, then the controller continues the search to determine if any Semi-private bins are available. If a Semi-private bin is found, then prints are delivered thereto and, via step 254, the user is notified of delivery location. If no Semi-private bin is available, then the prints are delivered to a Public bin and the user is notified of the delivery location. In the illustrated embodiment of FIG. 6, open private bins are assigned to users prior to Semi-private bins and Semi-private bins are assigned prior to Public bins so as to optimize space in the public bins; however, in another embodiment public bins could be assigned prior to Semi-private bins and so on.

Figure 8:
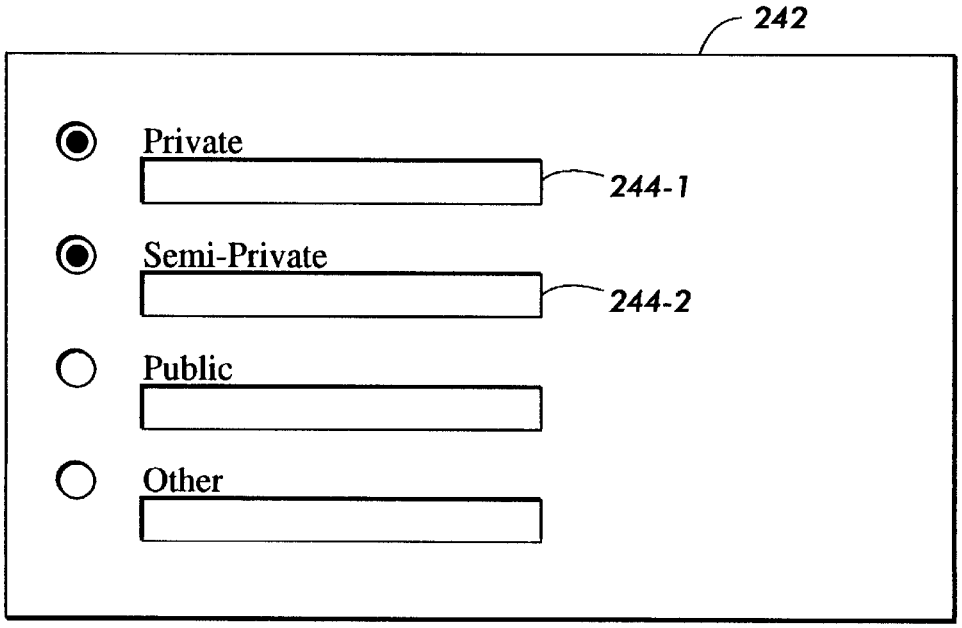

Referring again to step 250, if a request includes a preference as to print delivery, then a preference statement is read at step 260. A preference statement can assume at least one of three forms. Referring to the first form, with the dialog 242 of FIG. 7, a user may indicate that s/he wishes to deliver prints to one of either one, two or three different types of bins, i.e. the user may specify a delivery range. In the example of FIG. 8, a user has designated that the delivery range is to include Private and Semi-private bins. A search is then performed, via step 262, to determine whether a bin is available within the designated delivery range. If a bin in the delivery range is available, then delivery of output is achieved at step 264; otherwise, the user is provided with an opportunity, via step 266 and 268 to adjust the request. In the example of FIG. 8, upon learning that only Public bins are available, the user may wish to change the delivery range to Public and, shortly thereafter, visit the printer to avoid having the corresponding output mixed up with other output.

Figure 9:
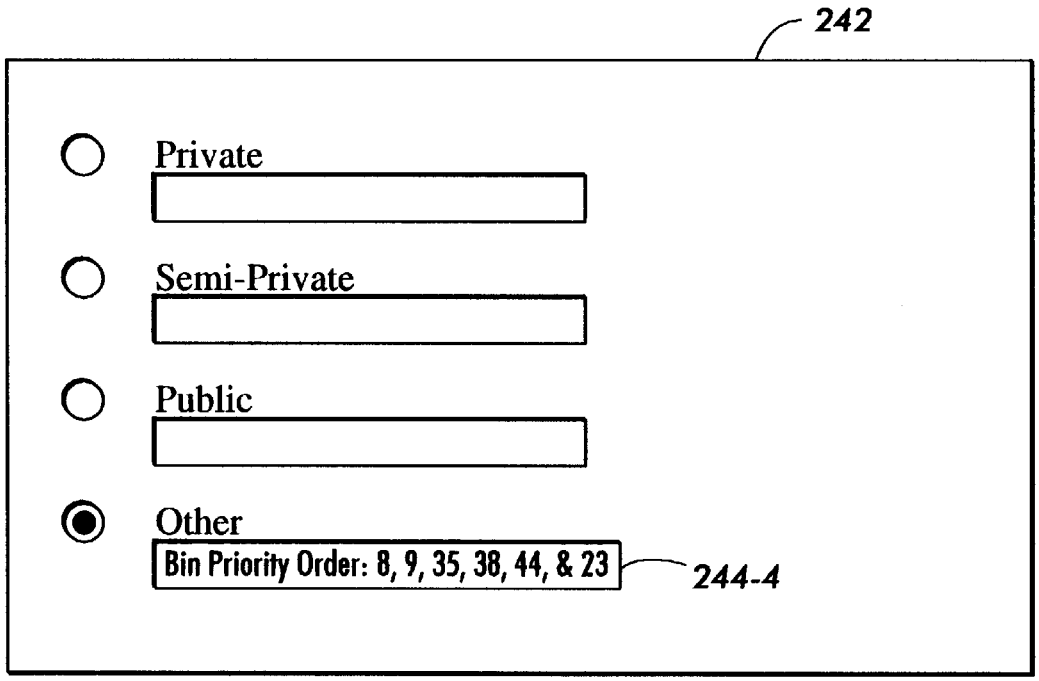

Referring to the second form of the preference statement, a user may provide a preference list by use of the Other designation. This approach is best understood by reference to an example: In a 56 bin mailbox bin subsystem, John has Private bins (#s 7, 8 and 9) and four Shared bins (#s 23, 35, 38 and 44) to which he has access—bin #9 is secured by an electronic lock while each of the other bins are nonsecured. When John sends a secure job, he specifies a preference list of "9, 7 and 8" in the input/display area 244-1 (FIG. 7). On the other hand, for non-secure jobs a bin preference list of "8, 9, 35, 38, 44 and 23" is provided in the area 244-4 of FIG. 9. In the example of FIG. 9, the user enables a priority list by providing a recognized phrase, e.g. "Bin Priority Order" and following the phrase with bins that s/he owns.

Referring to the third form of the preference statement, it should be noted that use of a preference list can greatly facilitate the distribution of a job among a wide range of recipients. For instance, referring again to the example discussed immediately above, John may wish to deliver a copy of job output to himself as well as to each group with whom he shares bins 23, 35, 38 and 44. To enable this, he would type in area 244-4: "Distribute copy(ies) to: (7, 8 or 9) and (23, 35, 38 and 44)". In this way an output copy would be delivered to one of John's bins and to each of bins 23, 35, 38 and 44. It is further contemplated that multiple copies could be transmitted to each of the bins designated in the distribution list.

Numerous advantages of the above-disclosed embodiment will be apparent to those of ordinary skill in the art:

First, mailboxes are assigned in such a manner that at least three user class types can be differentiated. In this way, various levels of privacy, with respect to use, can be achieved. Thus, in one example, a mailbox can be used by a group of users and yet still maintain the privacy level of a private, single use mailbox.

Second, prints are delivered to a mailboxing system under the control of a request, the request being revisable by the deliverer. Accordingly, the delivery approach is an interactive one in which the user is empowered to overcome a system fault when it is determined that a certain class of mailbox bins cannot be accessed. In one example, the user alters his/her request to facilitate delivery of a corresponding job to a bin with less privacy.

Finally, the request can assume the form of a list which permits the user to achieve high levels of flexibility with respect to delivering job output throughout the mailbox bin subsystem. In one example, the user owns a plurality of mailbox bins with varying privacy level designations. In turn, the list is used to prioritize the plurality of bins so that the user is permitted to provide an indication of preference with respect to print delivery. In another example, the list is used to distribute one or more copies of job output to a plurality of bins in the mailbox system so that job output can be shared with multiple selected distributees.

What is claimed is:

1. In a sheet handling system where a controller communicates with a mailbox bin subsystem having a plurality of print receiving bins, a user requesting that one or more prints, produced in accordance with a set of control instructions for a document job be delivered to the mailbox bin subsystem, the controller causing the one or more produced prints to be delivered to one or more of the print receiving bins in response to receiving a request communicated thereto by the user, a method for controlling delivery of the one or more produced prints to the mailbox bin subsystem, comprising:

(a) grouping the plurality of bins into a first print receiving bin set, a second print receiving bin set and a third print receiving bin set with the first print receiving bin set including one or more print receiving bins, the second print receiving bin set including one or more print receiving bins and the third print receiving bin set including one or more print receiving bins;

(b) assigning a first bin access designator to each print receiving bin of the first print receiving bin set, a second bin access designator to each print receiving bin in the second print receiving bin set and a third bin access designator to each print receiving bin in the third print receiving bin set, with the first, second and third bin access designators corresponding respectively with a first user class type, a second user class type and a third user class type;

(c) communicating the request to the controller;

(d) reading the request with the controller; and (e) in response to said (d), delivering the one or more produced prints to one or more print receiving bins in one or more of the first, second and third print receiving bin sets.

2. The method of claim 1, wherein said (e) includes:

(i) determining whether a print receiving bin is available in the first print receiving bin set prior to delivering the one or more produced prints thereto.

3. The method of claim 2, further comprising:

(f) determining whether a print receiving bin is available in the second print receiving bin set when it is determined, with said (e)(i) that no print receiving bins are available in the first print receiving bin set.

4. The method of claim 3, further comprising:

(g) delivering the one or more produced prints to one of the one or more print receiving bins in the third print receiving bin set when it is determined, with said (f), that no print receiving bins are available in either the first or second print receiving bin set.

5. The method of claim 4, in which the controller determines that the request does not include a preference as to which one of the first, second and third print receiving bin sets is to receive the one or more produced prints, wherein said (e) includes delivering the one or more produced prints to the third print receiving bin set.

6. The method of claim 1, further comprising:

(f) constraining access to each print receiving bin in the first print receiving bin set to one user only;

(g) constraining access to each print receiving bin in the second print receiving bin set to a select group of users; and (h) permitting any type of user to access each print receiving bin in the third print receiving bin set.

7. The method of claim 6, wherein said constraining of said (f) and said (g) is accomplished by electronically securing one or more of the print receiving bins of the first and second print receiving bin sets.

8. The method of claim 6, wherein said (g) includes:

(i) designating the select group in a list; and (ii) storing the list in a memory location accessible by the controller.

9. The method of claim 8, further comprising:

(i) said controller accessing the list for adding a user name thereto or deleting a user name therefrom.

10. The method of claim 6, further comprising:

(i) for one of one or more print receiving bins in either the first or second print receiving bin set, changing the accessibility of the one of the one or more print receiving bins, when a selected event occurs, so that a more or less users can access the one of the one or more print receiving bins.

11. The method of claim 10, in which the one or more produced prints are produced by a special user, wherein said selected event includes delivering the one or more produced prints of the special user to the one of the one or more print receiving bins.

12. The method of claim 1, further comprising:

(f) configuring the request to indicate a preference as to which one of the first, second and third print receiving bin sets is to receive the one or more produced prints.

13. The method of claim 12, further comprising:

(g) using the controller, denying delivery of the one or more produced prints to the one print receiving set indicated by the request.

14. The method of claim 13, further comprising:

(h) in response to said denying, changing the request to indicate another one of the first, second and third receiving bin sets for receiving the one or more produced prints.

15. In a sheet handling system where a controller communicates with a mailbox bin subsystem having a plurality of print receiving bins, a user requesting that one or more prints, produced in accordance with a set of control instructions for a document job be delivered to the mailbox bin subsystem, the controller causing the one or more produced prints to be delivered to one or more of the print receiving bins in response to receiving a request communicated thereto by the user, a method for controlling delivery of the one or more produced prints to the mailbox bin subsystem, comprising:

(a) grouping the plurality of bins into a first print receiving bin set, a second print receiving bin set and a third print receiving bin set with the first print receiving bin set including one or more print receiving bins, the second print receiving bin set including one or more print receiving bins and the third print receiving bin set including one or more print receiving bins;

(b) assigning a first bin access designator to each print receiving bin of the first print receiving bin set, a second bin access designator to each print receiving bin in the second print receiving bin set and a third bin access designator to each print receiving bin in the third print receiving bin set, with the first, second and third bin access designators corresponding respectively with a first user class type, a second user class type and a third user class type;

(c) configuring the request to indicate a preference as to which one of the first, second and third print receiving bin sets is to receive the one or more produced prints, wherein said preference is provided in the form of a list designating one or more print receiving bins to which the one or more produced prints are to be delivered;

(d) communicating the request to the controller;

(e) reading the request with the controller; and (f) in response to said (e), delivering the one or more produced prints to the one or more print receiving bins designated in the request when the one or more print receiving bins designated by the request are available to receive the one or more produced prints.

16. The method of claim 15, in which a plurality of print receiving bins is designated by the list, further comprising configuring the list so that a copy of the one or more produced prints is distributed to each of the plurality of print receiving bins.

17. The method of claim 15, in which a plurality of print receiving bins is designated by the list, further comprising configuring the list so that one or more copies of the one or more produced prints are delivered to less than all of the plurality of print receiving bins.

* * * * *